US010458194B2

(12) United States Patent
Zhao et al.

(10) Patent No.: US 10,458,194 B2
(45) Date of Patent: Oct. 29, 2019

(54) MANDREL SUPPORTED FLEXIBLE SUPPORT RING ASSEMBLY

(71) Applicant: Baker Hughes, a GE company, LLC, Houston, TX (US)

(72) Inventors: Lei Zhao, Houston, TX (US); Zhiyue Xu, Cypress, TX (US); Zhi Yong He, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 147 days.

(21) Appl. No.: 15/645,731

(22) Filed: Jul. 10, 2017

(65) Prior Publication Data

US 2019/0010771 A1 Jan. 10, 2019

(51) Int. Cl.

| | |
|---|---|
| ***E21B 17/10*** | (2006.01) |
| ***E21B 23/01*** | (2006.01) |
| ***E21B 33/128*** | (2006.01) |
| *E21B 43/26* | (2006.01) |

(52) U.S. Cl.

CPC ..... *E21B 23/01* (2013.01); *E21B 17/1014* (2013.01); *E21B 33/128* (2013.01); *E21B 43/26* (2013.01)

(58) Field of Classification Search

CPC ..... E21B 17/1014; E21B 17/1021; E21B 17/1028; E21B 23/01; E21B 33/128

See application file for complete search history.

(56) References Cited

U.S. PATENT DOCUMENTS

| | | | | |
|---|---|---|---|---|
| 2,374,317 | A * | 4/1945 | Wright | E21B 17/1028 166/158 |
| 3,643,739 | A * | 2/1972 | Hall, Sr. | E21B 17/1028 166/173 |
| 4,424,865 | A * | 1/1984 | Payton, Jr. | E21B 33/1208 138/89 |
| 5,295,279 | A * | 3/1994 | Cooper | B08B 9/0557 15/104.061 |
| 5,944,102 | A | 8/1999 | Kilgore et al. | |
| 6,041,858 | A | 3/2000 | Arizmendi | |
| 6,102,117 | A | 8/2000 | Swor et al. | |
| 6,827,150 | B2 | 12/2004 | Luke | |
| 7,703,512 | B2 * | 4/2010 | Xu | E21B 33/126 166/187 |
| 8,109,340 | B2 | 2/2012 | Doane et al. | |
| 8,245,779 | B2 * | 8/2012 | Lemke | E21B 17/1021 166/241.6 |

(Continued)

*Primary Examiner* — Matthew R Buck
(74) *Attorney, Agent, or Firm* — Shawn Hunter

(57) ABSTRACT

Spring discs are rotationally locked to the mandrel are between pairs of actuation rings that feature a circumferential protrusion. On application of axial force release of a stored force from flexing, the protrusion engages a sloping portion of the spring disc and moves the sloping portion toward a more vertical orientation. Alternatively, a release of a stored force from flexing accomplishes the same result. Slots in the spring disc allow irregular growth to conform to surface irregularities of a surrounding surface. The discs can serve as anchors, centralizers or supports for a sealing element in a packer. Ends of fingers feature stiffeners to enhance strength. The discs can be stacked apart or together and oriented in the same or opposed directions. The can deliver an axial force when stacked and pushed toward flat and released.

37 Claims, 5 Drawing Sheets

(56) References Cited

U.S. PATENT DOCUMENTS

| | | | | |
|---|---|---|---|---|
| 8,356,377 | B2 * | 1/2013 | Harper | B08B 9/0557 15/104.061 |
| 8,651,178 | B2 * | 2/2014 | Mercer | E21B 23/06 166/121 |
| 8,701,787 | B2 | 4/2014 | Shkurti et al. | |
| 9,341,044 | B2 * | 5/2016 | Lehr | E21B 17/1014 |
| 9,399,894 | B2 * | 7/2016 | Perry | E21B 17/1057 |
| 9,624,752 | B2 * | 4/2017 | Resink | E21B 33/1208 |
| 2003/0042028 | A1 | 3/2003 | Lauritzen et al. | |
| 2004/0194971 | A1 * | 10/2004 | Thomson | E21B 33/14 166/387 |
| 2012/0217004 | A1 * | 8/2012 | Yee | E21B 33/1208 166/129 |
| 2014/0361497 | A1 | 12/2014 | Porta | |
| 2015/0330178 | A1 | 11/2015 | Williams et al. | |
| 2017/0037697 | A1 | 2/2017 | Kellogg | |

* cited by examiner

MANDREL SUPPORTED FLEXIBLE SUPPORT RING ASSEMBLY

FIELD OF THE INVENTION

The field of the invention is flexible supports from a mandrel for borehole use and more particularly packers or centralizers, for example, where the flexible support assembly conforms to irregular borehole shapes for direct or indirect contact with the borehole.

BACKGROUND OF THE INVENTION

There are many applications where zones in a borehole need isolation from each other in an annular space between a tubular string and the borehole wall. The borehole wall can be the formation and is referred to as open hole or there can be one or more casing strings attached in series in the case of a cased hole. Apart from the structure and shape of the borehole wall there are a large number of designs for annular barriers that need to span the gap between a tubular string in the borehole and the borehole wall. There are also a broad range of operating conditions that dictate the use of some known designs as opposed to others. In some cases the controlling criteria is pressure differential or/and service temperature. In other cases the percent expansion from the run in to the set dimension for the sealing element is controlling. Some designs use an external sleeve on a mandrel and internally expand the mandrel for high pressure isolation where there may be high temperatures well over 400 F, as shown in US 2003/0042028. Many designs simply axially compress an annularly shaped sealing element and employ embedded stiff rings at the opposed ends to control seal element extrusion as in U.S. Pat. No. 6,102,117. Others specially design the slip assemblies to handle high pressure differentials such as barrel shaped slips shown in U.S. Pat. No. 5,944,102. Yet other designs push a sealing element up a ramp to axially compress it and to bring it to the surrounding borehole wall as in U.S. Pat. No. 8,109,340. Some high expansion designs are shown in U.S. Pat. Nos. 6,827,150 and 6,041,858. Another design provides an extrusion barrier for a sealing element in the form of a slotted ring as in U.S. Pat. No. 8,701,787.

As an alternative to these designs a high pressure and temperature annular barrier is presented with a host of unique features. While actuation starts with an axial force along a mandrel that force moves a plurality of rings closer together. In between the actuation rings are spring discs rotationally locked to a mandrel. The actuation rings have an exterior circumferential projection which catches a sloping segment of an adjacent spring disc to exert a pivoting motion on the sloping portion of the spring disc such that a curled outer segment that is registered with a depression in a surrounding corrugated member results in pushing a respective corrugation radially. Externally the corrugated member has a series of valleys spaced between peaks. Those skilled in the art will not that the internal valleys where curled segments engage also define the spaced external peaks. A sealing material is disposed in the external valleys between the external peaks. The tube shaped corrugated member is design to yield as the sealing material in its outer valleys is pushed to the borehole wall. Because the sloping segment of the spring discs essentially rotates about the outer surface of the mandrel, the exterior valleys of the corrugated member get axially squeezed as the external peaks approach the borehole wall. This effect pushes the sealing material in the external valleys of the corrugated member out toward the borehole wall for enhanced sealing contact. The external peaks of the corrugated member also serve to control seal material extrusion in the axial direction along the length of the seal material as opposed to prior designs that focused extrusion control at ends of sealing elements. The corrugated member can be formed with one or more continuous spirals so that the sealing elements in the external groove can be continuous. Alternatively, the corrugations can be an array of parallel peaks and valleys with each external valley having a discrete seal ring. Optionally a the corrugated member itself can be a sealing element by the manner in which it is built such as with an external resilient coating that can handle the operating temperatures as high as 600 F.

The spring disc can be used by itself or in a stack or an array of separated discs in other applications than a high pressure high temperature packer described herein. These discs with their finger structure and end reinforcing in the form of a loop can be supported on a mandrel alone or in stacks or arrays and when rotationally locked have finger structures extending radially to conform to a surrounding environment, which could be an open hole borehole wall, a cased hole or some intermediate barrier that interacts with an irregular surface such as the packer application described herein or an anchor. The flexible fingers allow for a smaller run in dimension where the sleeve can be retracted to release the fingers to the set position. Alternatively, the discs can be run in relaxed and then actuated with flexing about a rigid base ring to radially extend further for a support or a barrier function using direct or indirect contact with the surrounding borehole. The base ring can be rotationally locked to a common mandrel.

These and other features will be more readily appreciated from a review of the detailed description of the preferred embodiment and the associated drawings while recognizing that the full scope of the invention is to be determined from the appended claims.

SUMMARY OF THE INVENTION

Spring discs are rotationally locked to the mandrel are between pairs of actuation rings that feature a circumferential protrusion. On application of axial force release of a stored force from flexing, the protrusion engages a sloping portion of the spring disc and moves the sloping portion toward a more vertical orientation. Alternatively, a release of a stored force from flexing accomplishes the same result. Slots in the spring disc allow irregular growth to conform to surface irregularities of a surrounding surface. The discs can serve as anchors, centralizers or supports for a sealing element in a packer. Ends of fingers feature stiffeners to enhance strength. The discs can be stacked apart or together and oriented in the same or opposed directions. The can deliver an axial force when stacked and pushed toward flat and released.

DETAILED DESCRIPTION OF THE PREFERRED EMBODIMENT

Figure 1:
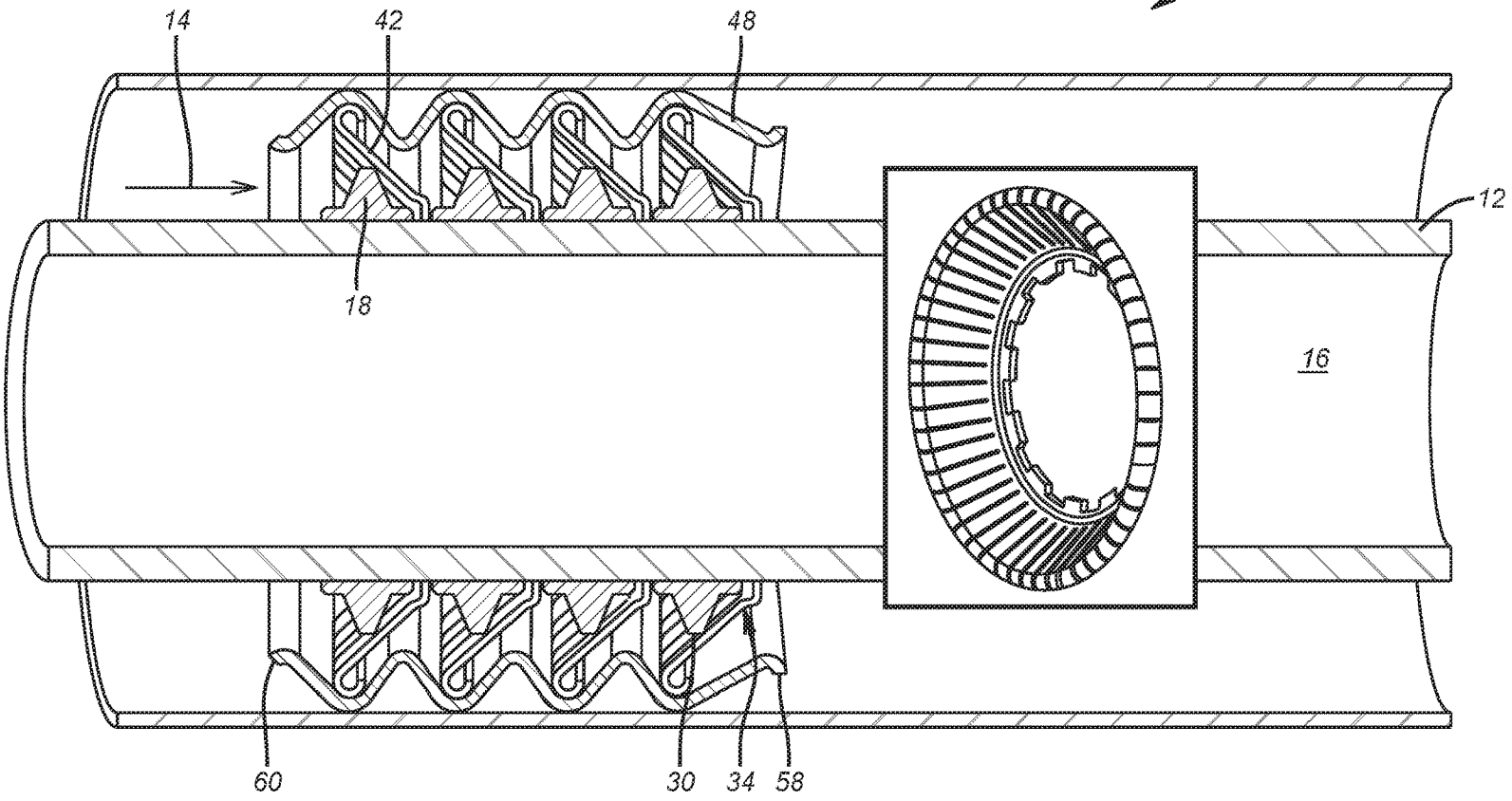
FIG. 1 is a section view of the packer in the set position with an inset enlarged perspective view of the spring disc.

Referring to FIG. 1, the elements of the packer 10 will be described. Mandrel 12 has preferably a tubing pressure actuation and selective locking system of a type known in the art and is schematically represented by arrow 14. This system can involve a wall port to an annular piston whose axial movement can be releasably locked such as with a body lock ring that can subsequently be undermined in the packer 10 is to be retrievable. Typically tubing passage 16 would be isolated below a wall port to the annular piston by a ball dropped on a seat. Applied pressure on the seated ball is communicated to the annular piston for the exertion of a setting force on the packer 10 in the direction of arrow 14. The force generation for setting packer 10 can be downhole from it as opposed to uphole as shown.

Figure 2:
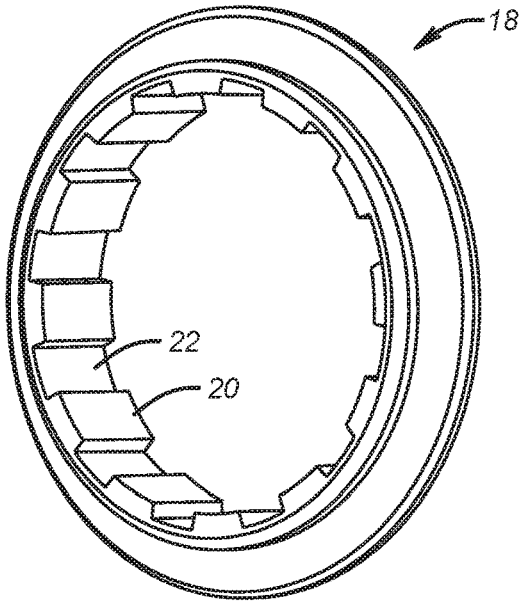
FIG. 2 is a perspective view of an actuator ring.
Figure 3:
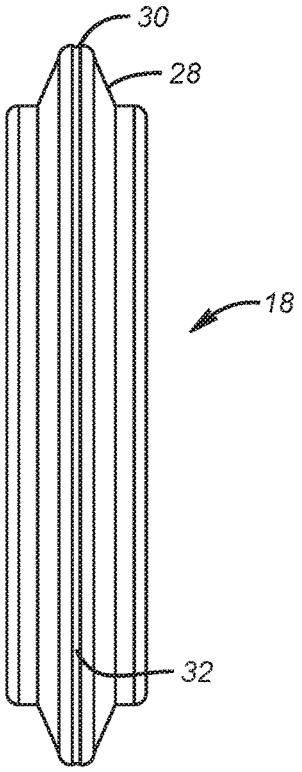
FIG. 3 is an outside end view of the actuator ring of FIG. 2.
Figure 4:
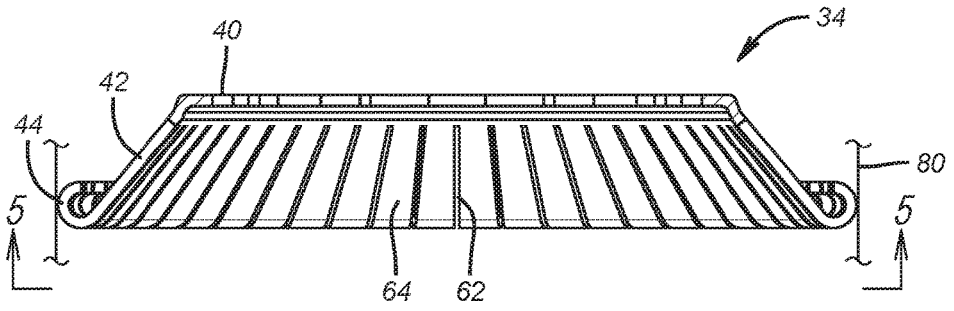
FIG. 4 is a section view of the spring disc.
Figure 7:
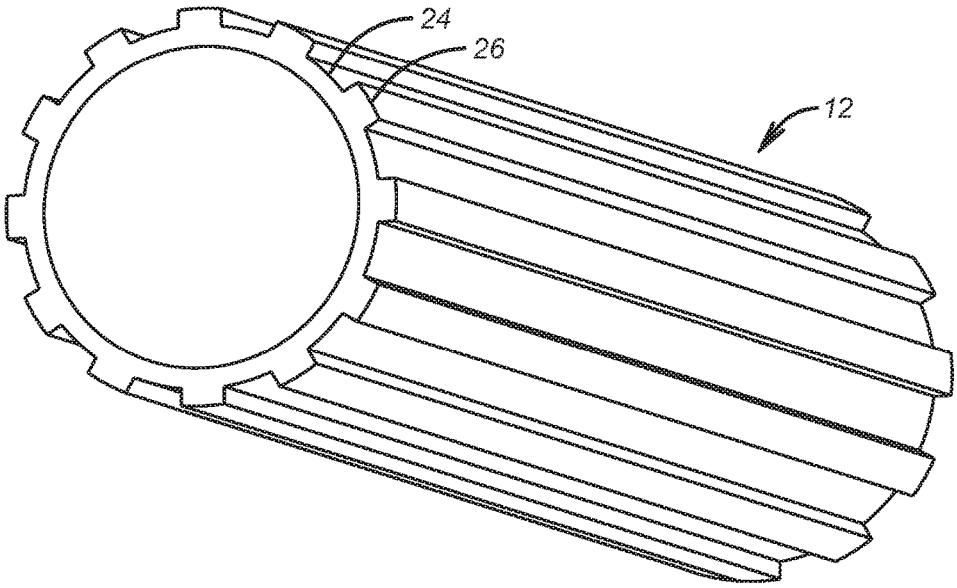
FIG. 7 is a perspective view of the mandrel showing a rotational locking feature.

A series of actuator rings 18 are shown in more detail in FIGS. 2 and 3. It features alternating projections 20 and depressions 22 that respectively engage depressions 24 and projections 26 on mandrel 12 that are shown in FIG. 7. In this manner the actuator rings 18 are able to slide axially when the schematically illustrated actuation force shown as arrow 14 is applied. The actuator rings 18 are thus rotationally locked to the mandrel 12. While the array of meshing projections and depressions that register with each other between the mandrel 12 and the actuator rings 18 appears as alternating quadrilateral shapes in section, other meshing patterns and shapes are contemplated to achieve rotational locking. As another alternative the mandrel 12 and actuator rings 18 can be rotationally locked with one or more keys on one in a keyway on the other. Optionally, the rotational locking can also be eliminated.

Referring back to FIGS. 2 and 3, the actuator rings have a circumferential projection 28 that is shown continuous but can be in separated segments with a taper toward apex 30. Apex 30 need not come to a point and can be flat or another shape, although flat is illustrated. Optionally, there can be an insert in a circumferential groove 32 in the apex 30. As best seen in FIG. 1, the side or top of the apex 30 is what makes contact with spring disc 34 when the actuation system 14 is energized.

Figure 5:
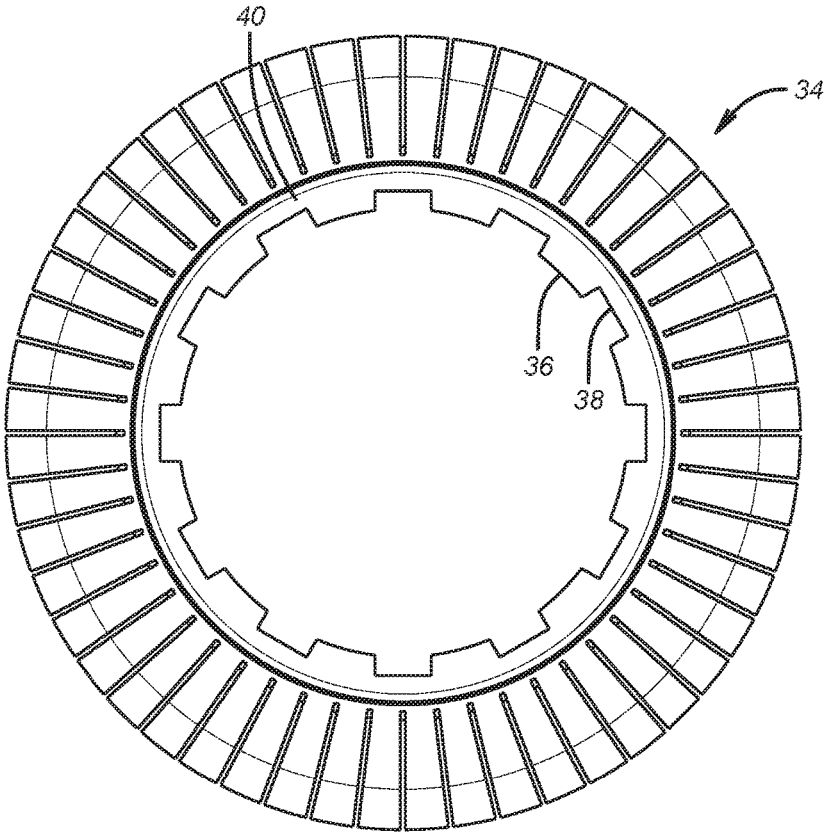
FIG. 5 is an end of the spring disc of FIG. 4 taken along line 5-5.
Figure 6:
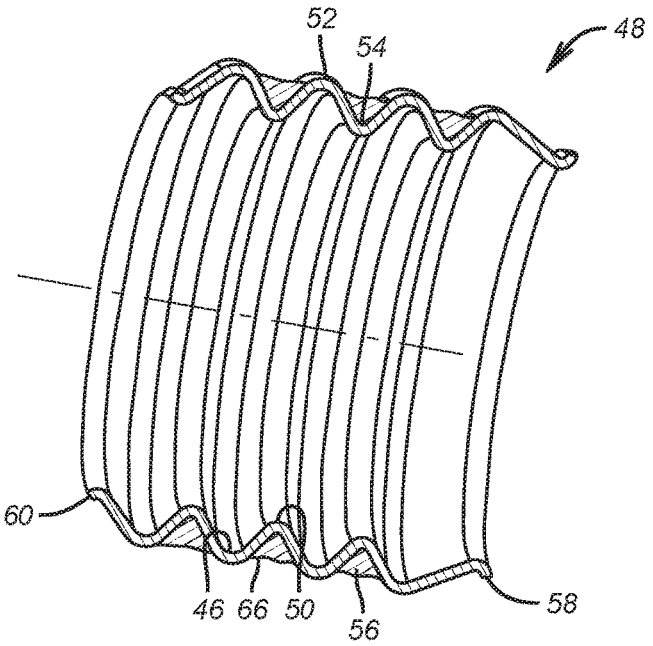
FIG. 6 is a section view of the tubular sealing element support.
Figure 8:
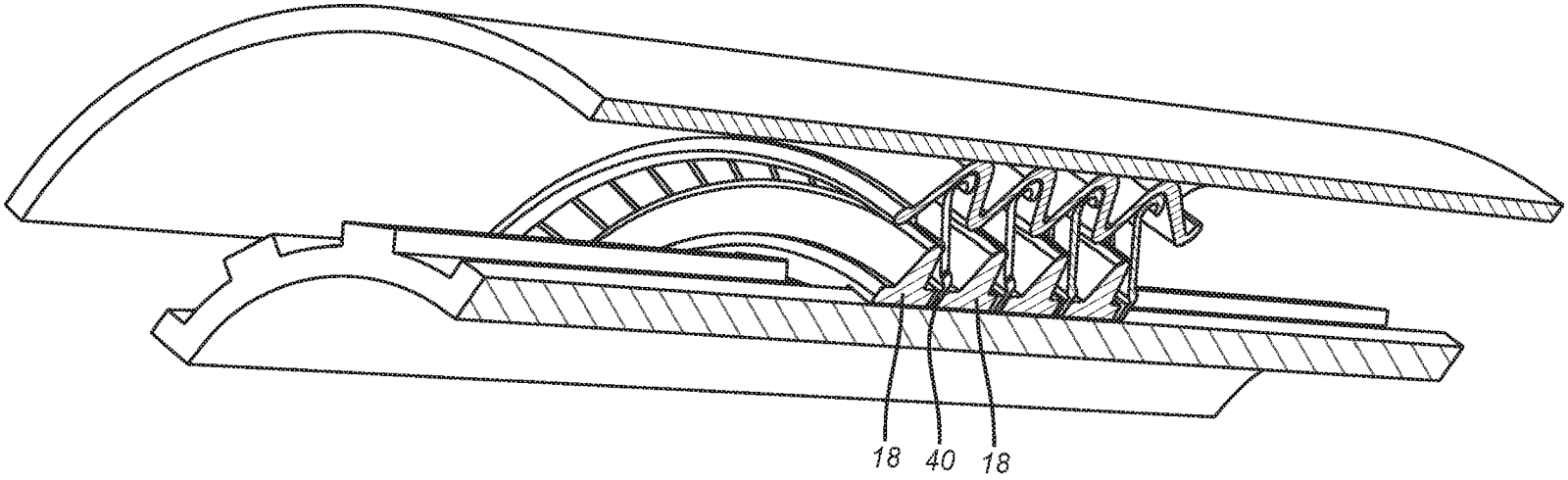
FIG. 8 is a perspective view of FIG. 1 with the packer in the set position.

The details of spring discs 34 are best seen in FIGS. 5 and 6. Discs 34 are mounted to mandrel 12 in much the same manner as actuator rings 18 and in an alternating pattern shown in FIGS. 1 and 8. Discs 34 are preferably locked to mandrel 12 against relative rotation but that feature is also optional. Spring disc 34 has alternating projections 36 and depressions 38 that respectively mesh with depressions 24 and projections 26 on mandrel 12. As with the actuator rings 18 the rotational locking of the spring discs 34 to the mandrel 12 can be accomplished in a variety of ways previously described. Projections 38 and depressions 36 are integral to a base ring 40 which is generally perpendicular to mandrel 12 and retained in that position by being disposed between a pair of actuator rings 18 as shown in FIG. 8 in the set position. Extending from base ring 40 and in a direction away from mandrel 12 is a tapered segment 42 that terminates in a preferably open loop 44. Alternatively, loop 44 instead of having a free end can come back around into contact with tapered segment 42. Loop 44 gives end rigidity to the tapered segment 42. It also engages valleys 46 of tubular sealing element support 48.

Referring to FIG. 6 for some details of the support 48 it can be seen that it resembles a bellows shape with alternating internal peaks 50 and valleys 46. The exterior has alternating peaks 54 and valleys 54. A seal material 56 can fill each exterior valley 54. There are alternatives such as coating the exterior surfaces of support 48 with a resilient material that can take the service temperatures. The support 48 is preferably a soft metal alloy of preferably copper or nickel whose thickness will depend on the desired differential pressure rating. While a bellows design as shown is preferred the configuration can be one or more continuous spirals in which case the sealing material can also be a continuous spiral in a continuous valley 54.

Getting back to the spring disc 34 the tapered segment 42 has spaced slots 62 starting near base ring 40 but on the tapered segment 42 and terminating at the end of loop 44 whether it is open as shown or closed. The slots 62 create a 360 degree array of flexible fingers 64 that have independent movement. This feature comes into play in making the assembly adaptable to respond to a range of borehole sizes due to casing weights, or to borehole wall out of round portions or partial collapse or any other condition that could cause out of roundness in the borehole wall. Of course, in open hole there is a potential for greater out of roundness occurring. However, the preferred use for the described design is in cased hole.

Getting back to FIG. 6 the support 48 has opposed ends 58 and 60. Preferably end 58 is at the opposite end from where the actuation system 14 applies a force to the actuator rings 18 and is closed off and held against a stop on mandrel 12 on a portion of mandrel 12 where the depressions 24 and projections 26 have stopped so that the mandrel 12 outer surface is amenable to be sealed against a closure for end 58. End 60 is also closed against mandrel 12 again in a zone where the depressions 24 and projections 26 have stopped so that the mandrel 12 outer surface is amenable to be sealed against a closure for end 60. The actuation system schematically referred to as 14 is preferably within the closure for end 60 so that applied tubing pressure to an annular piston can apply an axial force directly to the alternating array of actuator rings 18 and spring discs 34. It should be noted that for running in there are axial gaps between the actuator rings 18 so that the support 48 and the seal 56 in valleys 54 is at a smaller dimension for running in. The seal material 56 can be retained in valley(s) 54 with a protective covering for running in. That covering 66 can stay intact or it can disintegrate with time or exposure to well fluids.

FIGS. 1 and 8 show the way the parts described above are assembled and where they are in the set position. These FIGS. will be used to describe the mechanics of how the assembly moves from the run in to the set position. The actuator rings 18 for running in have some space between them axially that closes up as the packer 10 is actuated with the pressure setting assembly 14. Each apex 30 engages tapered segment 42 preferably around midpoint and all the fingers 64 are pivoted clockwise about base ring 40. Loops 44 are nested in valleys 46 of support 48. Each valley 46 has a respective spring disc 34 with its end loop 44 in a respective valley 46. What results is the diameter of support 48 grows radially taking with it the sealing rings or continuous spiral 56. As the radial movement of support 48 occurs, valleys 54 can close up somewhat in the axial direction because support 48 is held fixed at end 58 and the flexing of the tapered segments 42 are toward end 58. This tends to push out the sealing rings or spiral 56 into the surrounding borehole wall and into any irregularities or out of roundness that it might have. Additionally, the peaks 52 are pushed radially out into the surrounding borehole wall and into any irregularities such as out of roundness that may exist. Further, the fact that the fingers 64 can flex independently of each other also helps push the support 48 out further where needed into voids or less where needed if there is a narrowing of the borehole wall in a particular circumferential orientation. The fingers 64 can push out more or less against support 48 and accordingly against seal 56 depending on the borehole contour that is encountered. Moreover, when peaks 52 get pushed against the borehole wall, they act as extrusion barriers at points other than ends of a sealing element as done in the past. If there is a bellows shape to support 48 then there are pairs of peaks 52 for each seal ring 56 between them. On the other hand, if there is a continuous spiral to the shape of support 48 there is in effect a continuous spiral seal 56 flanked on opposed sides with peaks 52 wrapping around the periphery of support 48 one or more times between the ends 58 and 60. Another feature of the packer 10 is that it is set with radial force created between mandrel 12 and sealing element 56 without need for expansion from within the mandrel 12. The radial movement of the assembly of support 48 and sealing element 56 moves radially more reliably than in situations with opposed axial forces on an end of a sealing element which in the past has resulted in part of the element bulging into contact while an adjacent part makes no sealing contact at all with the borehole or other instances where the extending sealing element traps well fluid between itself and the borehole which can compromise the seal. Depending on the configuration of the wall shape of support 48 high expansion applications are also possible where the diameter percentage change between run in and set can exceed 25%. High differential pressure capability is provided from several features at play in the setting of the packer 10. Some of these factors are the sealing element 56 coming out evenly radially and being trapped along its length with peaks 52. Other aspects are the closing of the valleys 54 with seal 56 to increase contact force with the borehole. Finally the radial flexibility of the fingers 64 and the surrounding support 48 further ensures conformity to the borehole shape and heightened contact area for the sealing element 56.

Referring back to the spring disc 34 it has independent use by itself singly or in spaced arrays or in nested stacks. The fact that fingers 64 flex independently allows the spring disc structure to act as an effective tubular centralizer in a borehole as some fingers will more than others to compensate for borehole irregularities. Loop end 44 lends structural rigidity because it forms a stiffer end structure. Loop ends 44 provide a net force on the surrounding structure that is resisted from said base ring 40. In this manner the tapered segment 42 bridges the gap between the mandrel and the surrounding structure to fixate or centralize the mandrel or to move the surrounding structure outwardly as in a packer application or to create an annular obstruction in yet other applications. Making the slots 62 stop short of base ring 40 provides rigidity at an opposite end from loop 44. The shape of spring disc 34 has similarities to Belleville washers and stacks of them can also serve to store and release potential energy. Using the peaks 36 and valleys 38 with a mandrel as described above can keep fingers in a stack of spring disc 34 in alignment so that all the fingers of adjacent spring disc maintain full overlap to avoid binding.

Other applications can be to encase the spring discs in a retractable sleeve for running in at a small dimension and then allowing the tapered segment 42 to flex to conform a surrounding space even if it is irregular due to the independent nature of the flexing fingers 64 when acting alone or if in an abutting stack. The uses can be for anchoring or centralizing involving direct borehole wall contact or indirect borehole wall contact when used in an application such as a packer described above. When used to deliver axial force such as when stacked and flattened and then released to flex to a relaxed position the potential energy that is released can be used to operate a borehole tool with axial movement. Rotational alignment in such an application can be optional as the entirety of the tapered segments 42 flex as a unit rather than individual fingers flexing different amounts to conform to irregular surrounding shapes. Ends 44 can be open loops as shown or closed loops or the material can simply be bent back on itself to constitute a stiffener at the peripheral free end of the tapered segment 42. While in the preferred design the mandrel and base ring 40 are not radially expanded, in some applications the outside diameter can be further extended with mandrel expansion in combination with flexing of the tapered segment 42. The dimensional change in the radial direction is accomplished with flexing of the fingers 64 rather than the circumferential spreading apart of the fingers 64 although slots 62 will get somewhat wider due to their circular array combined with flexing with respect to the base ring 40. A retaining sleeve 80 can pre-flex the fingers 64 for running in and be retracted at the desired location to allow the fingers 64 to flex out to the surrounding surface and take its shape while applying a residual force against the surrounding surface. Instead of loops 44 fingers 64 can simply have thicker ends as a means of end reinforcement. This can be done with folding over the finger ends or simply adding more metal strips to the finger end or just machining the entire assembly with thicker ends. The transition between the base 40 and the tapered segment 42 can be angular as shown or curved.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The above description is illustrative of the preferred embodiment and many modifications may be made by those skilled in the art without departing from the invention whose scope is to be determined from the literal and equivalent scope of the claims below:

We claim:

1. An assembly for supporting or positioning a mandrel with respect to a surrounding surface defining a borehole, comprising:

at least one base comprising an opening for the mandrel;

at least one tapered segment extending from said base further comprising a plurality of slots defining fingers therebetween, said fingers having stiffened ends spaced from said base;

said fingers flexing independently of each other relative to said base to conform to a shape of the surrounding surface while exerting a force against the surrounding surface;

a tubular sealing element support which radially surrounds the at least one tapered segment, the tubular sealing element support presenting a plurality of alternating external peaks and valleys and a corresponding plurality of alternating internal valleys and peaks; and wherein the tubular sealing element support is urged into contact with the surrounding surface as the ends of the fingers are urged into the internal valleys.

2. The assembly of claim 1, wherein:

said opening comprises a surface irregularity for rotationally locking said base to the mandrel.

3. The assembly of claim 2, wherein:

said irregularity further comprising at least one projection and associated depression.

4. The assembly of claim 3, wherein:

said at least one projection and associated depression comprises a plurality of alternating projections and depressions having a quadrilateral shape.

5. The assembly of claim 1, wherein:

said slots on said tapered segment stop short of said base.

6. The assembly of claim 1, wherein:

the stiffened ends comprise said ends formed into loops.

7. The assembly of claim 6, wherein:

said loops are open.

8. The assembly of claim 6, wherein:

said loops are closed.

9. The assembly of claim 1, wherein:

said stiffened ends comprise a folding over of respective said fingers or a thicker dimension.

10. The assembly of claim 1, wherein:

said slots extend to said ends.

11. The assembly of claim 1, wherein:

said fingers flex different angular distances to conform respective said ends to an irregular surrounding surface.

12. The assembly of claim 1, wherein:

said fingers are initially retained so that said ends define an initial diameter, said fingers selectively released to flex to a shape of the surrounding surface while applying a force thereto.

13. The assembly of claim 1, wherein:

said fingers forcibly flexed to engage the surrounding surface while applying a force thereto.

14. The assembly of claim 1, wherein:

said at least one base and tapered segment comprises a plurality of bases and tapered segments on the mandrel oriented in the same or opposite directions.

15. The assembly of claim 14, wherein:

said bases and tapered segments are spaced apart or stacked in contact with each other.

16. The assembly of claim 15, wherein:

said bases and tapered segments are locked against relative rotation.

17. The assembly of claim 14, wherein:

said fingers support or centralize the mandrel from the surrounding surface when in contact therewith.

18. A method of supporting or positioning a mandrel with respect to a surrounding surface defining a borehole, comprising:

mounting at least one ring shaped object to the mandrel that further comprises;

at least one base comprising an opening for the mandrel;

at least one tapered segment extending from said base further comprising a plurality of slots defining fingers therebetween, said fingers having stiffened ends spaced from said base;

a tubular sealing element support radially surrounding the at least one tapered segment, the tubular sealing element support presenting a plurality of alternating external peaks and valleys and a corresponding plurality of alternating internal valleys and peaks;

flexing said fingers independently of each other relative to said base to conform to a shape of the surrounding surface, so that the ends of the fingers are urged into the internal valleys to exert a force against the surrounding surface.

19. The method of claim 18, comprising:

providing a surface irregularity in said opening for rotationally locking said base to the mandrel.

20. The method of claim 19, comprising:

forming said irregularity with at least one projection and associated depression.

21. The method of claim 20, comprising:

providing as said at least one projection and associated depression a plurality of alternating projections and depressions having a quadrilateral shape.

22. The method of claim 18, comprising:

extending said slots on said tapered segment to stop short of said base.

23. The method of claim 18, comprising:

forming said ends into loops to create said stiffened ends.

24. The method of claim 23, comprising:

making said loops open.

25. The method of claim 23, comprising:

making said loops closed.

26. The method of claim 18, comprising:

folding over of respective said fingers or providing a thicker dimension for said stiffened ends of said fingers.

27. The method of claim 18, comprising:

extending said slots to said ends.

28. The method of claim 18, comprising:

flexing said fingers different angular distances to conform respective said ends to an irregular surrounding surface.

29. The method of claim 18, comprising:

initially retaining said fingers so that said ends define an initial diameter;

selectively releasing said fingers to flex to a shape of the surrounding surface while applying a force thereto.

30. The method of claim 18, comprising:

forcibly flexing said fingers to engage the surrounding surface while applying a force thereto.

31. The method of claim 18, comprising:

providing as said at least one base and tapered segment a plurality of bases and tapered segments on the mandrel oriented in the same or in opposite directions.

32. The method of claim 31, comprising:

spacing apart or stacking in contact said bases and tapered segments with each other.

33. The method of claim 32, comprising:

locking said bases and tapered segments against relative rotation.

34. The method of claim 31, comprising:

supporting or centralizing the mandrel from the surrounding surface when in contact therewith with said fingers.

35. The method of claim 31, comprising:

supporting a sealing element upon said tubular sealing element support in contact with the surrounding surface with said fingers.

36. The method of claim 35, comprising:

performing a treatment of a formation adjacent the borehole against said sealing element.

37. The method of claim 36, comprising:

fracturing the adjacent formation as said performing.

* * * * *